United States Patent [19]

Shivers

[11] Patent Number: 4,621,426

[45] Date of Patent: Nov. 11, 1986

[54] LOCKING COVER ASSEMBLY FOR USE WITH A CHAIN SAW

[76] Inventor: Horace L. Shivers, 21 Fillmore St., Trenton, N.J. 08638

[21] Appl. No.: 783,892

[22] Filed: Oct. 3, 1985

[51] Int. Cl.[4] ..... B27B 17/02

[52] U.S. Cl. ..... 30/382; 30/391

[58] Field of Search ..... 30/382, 381, 383, 391, 30/161

[56] References Cited

U.S. PATENT DOCUMENTS

| | | | |
|---|---|---|---|
| 1,942,766 | 1/1934 | O'Banion | 30/391 |
| 2,937,673 | 5/1960 | Duperron et al. | 30/161 |
| 3,059,673 | 10/1962 | Woleslagle | 30/382 X |
| 3,230,987 | 1/1966 | Woleslagle | 30/382 |
| 3,326,250 | 6/1967 | Kephart | 30/382 |
| 3,327,743 | 6/1967 | Long et al. | 30/382 X |
| 3,754,328 | 8/1973 | Knerr | 30/382 |
| 3,808,684 | 5/1974 | Ludwig | 30/382 |
| 4,060,894 | 12/1977 | Hampton | 30/382 |
| 4,063,358 | 12/1977 | Hodge | 30/382 |
| 4,257,162 | 3/1981 | Pardon | 30/382 |

*Primary Examiner*—Jimmy C. Peters

*Attorney, Agent, or Firm*—Sperry, Zoda & Kane

[57] ABSTRACT

A locking cover assembly is disclosed which is particularly usable with a conventional chain saw wherein the assembly includes a cover extending about and surrounding the chain and bar cutting assembly of the chain saw while defining a slot extending longitudinally along the bottom edge thereof to facilitate cutting. The cover is hingedly secured with respect to the housing of the chain saw to allow the cover to swing vertically upwardly responsive to cutting movement by the cutting assembly. Wing members are included extending longitudinally along the slot to facilitate movement of the cover during cutting. A biasing spring is included for holding the cover in the down enclosed position when the cutting assembly is not in use. A locking apparatus is included which has a plurality of guide rods fixedly secured with respect to the housing and defining apertures through which a movable locking pin extends. This locking pin is pivotally secured with respect to a wheel means which is movable between a closed position and an open position to facilitate locking of the cover means in a down position. A spring means is included for holding the locking pin and wheel in the closed position unless the locking apparatus has been moved by pulling against the lock trigger by the user. A rear runner and a front runner are positioned upon the top of the hinge to facilitate the downward bias exerted by the wheel means to hold the cover in the locked or unlocked positions.

10 Claims, 13 Drawing Figures

LOCKING COVER ASSEMBLY FOR USE WITH A CHAIN SAW

BACKGROUND OF THE INVENTION

1. Field of the Invention

The present invention deals with the field of safety devices for use with chain saws. Chain saws throughout the years since the invention thereof have provided much usefulness both commercially and as consumer products. However, they are prone to cause rather severe injuries. As a result, a number of devices have been designed to provide protection. The present invention is included in that class of devices which provides covers which can be locked in place surrounding the chain and bar cutting assembly and is detachably removable directly or by being rotated out of position surrounding the chain.

2. Description of the Prior Art

Other devices which have been utilized to protect against chain saw injuries include U.S. Pat. No 2,937,673 patented May 24, 1960 to L. J. Duperron et al on a Chain Saw Guard. Another device was patented Oct. 23, 1962 to A. Woleslagle on a Safety Guard for Chain Saw which was given U.S. Pat. No. 3,059,673. Another patent to inventor A. Woleslagle was U.S. Pat. No. 3,230,987 on a Chain Saw Guard patented Jan. 25, 1966. Other patents on similar devices include U.S Pat. No. 3,326,250 patented June 20, 1967 to C. B. Kephart, Jr. on a Chain Saw and Protective Cover Therefor, and U.S. Pat. No. 3,327,743 patented June 27, 1967 to M. E. Long et al on a Chain Saw Guard; U.S. Pat. No. 3,808,684 patented May 7, 1974 to Robert L. Ludwig on an Attachment for a Chain Saw; U.S. Pat. No. 4,063,358 patented Dec. 20, 1977 to G. J. Hodge on a Guard for a Chain Saw Used For Carving; and U.S. Pat. No. 4,257,162 patented Mar. 24, 1981 John T. Pardon on a Chain Saw Guard.

SUMMARY OF THE INVENTION

The present invention provides a locking cover assembly particularly usable with conventional chain saws which have housings, start triggers and cutting assemblies including a chain and bar. The present locking cover assembly includes a hinge means having a rear hinge member and a front hinge member which are pivotally secured with respect to one another. The rear hinge member is designed to be fixedly secured with respect to the housing of the chain saw.

A cover means is included positioned extending about and surrounding the chain and bar cutting assembly and including a cutting slot running along the bottom edge thereof. This cover also includes a tongue means which is fixedly secured thereto and is fixedly secured with respect to the front hinge member to allow the cover means to be pivotally secured with respect to the housing by way of the pivotal securement between the rear hinge member and the front hinge member. A cover biasing means is included secured with respect to the front hinge member and with respect to the rear hinge member to urge the cover means into the closed position wherein it covers the chain and bar cutting assembly.

A very important locking apparatus is included in the configuration wherein a plurality of guide rods are fixedly secured into the housing and each defines a guide aperture therethrough. A guide pin is positioned extending through these guide apertures and is longitudinally movable therethrough between a closed position adjacent to the tongue means of the cover and an opened position adjacent to the housing of the chain saw. A wheel means is rotationally secured with respect to the end of the locking pin adjacent to the cover and includes a slot therein across which extends a wheel axle. The wheel means itself is actually mounted onto the wheel axle at the end such that it abuts the hinge means. This wheel means is movable responsive to movement of the locking pin from the closed position to the open position and vice versa to exert a downwardly directed bias onto the hinge means. When in the closed position the locking pin exerts a downwardly directed bias on the rear hinge member and when in the closed position the wheel means exerts a downwardly directed bias on the front hinge member.

A locking pin spring or biasing means can be positioned adjacent the locking pin to urge it toward the closed position. A locking trigger is also included such that when it is pulled the locking pin will move to the opened position. This locking trigger preferably is positioned adjacent to the start trigger of the conventional chain saw.

Preferably a washer means is fixedly retained with respect to the locking pin and another washer means is fixedly secured with respect to the guide rod with locking pin spring wound around the locking pin and positioned between these two washer means. In this manner the locking pin will be biased into the locking position unless the lock trigger is pulled wherein it will be moved to the opened position.

Preferably the cover means includes a plurality of ventilating holes therein to prevent floating of the cover as it is moved downward into the enclosing or closed position. To facilitate the guiding of the movement of the wheel means across the top of the hinge a wheel rear runner is fixedly secured with respect to the rear hinge member and a wheel front runner is fixedly secured with respect to the tongue means such as to guide movement of the wheel means from being immediately above the front hinge member to being immediately above the rear hinge member and vice versa and to facilitate downwardly directed bias exerted by the wheel means when the locking pin is in the closed position or in the opened position.

A stop bar means is also included which is fixedly secured with respect to the front hinge member. Also a stopper bar plate is included fixedly secured with respect to the housing and positioned adjacent to the stop bar means wherein it is adapted to be abutted selectively by the stop bar means to limit the downward degree of freedom of movement of the cover means with respect to the chain and bar cutting assembly to maintain whatever predetermined required distance is necessary between the inside of the cover means and the bar and chain cutting assembly.

The present invention may further include wing means extending longitudinally along each side of the cutting slot to abut the workpiece during cutting to facilitate upward movement of the cover means as the chain and bar cutting assembly cuts downwardly through the workpiece. These wing means will facilitate the abutment between the cover member and the sides of the cut being made by the chain saw and improve the characteristics of movement of the cutting means vertically away from the cutting assembly as it moves downwardly through the workpiece.

It is an object of the present invention to provide a locking cover assembly which is a reliable safety apparatus.

It is an object of the present invention to provide a locking cover assembly which is relatively simple in construction.

It is an object of the present invention to provide a locking cover assembly which is easy to maintain.

It is an object of the present invention to provide a locking cover assembly which includes a minimum number of moving parts.

It is an object of the present invention to provide a locking cover assembly which is particularly usable with a conventional chain saw having a housing, a start trigger and a chain and bar cutting assembly.

It is an object of the present invention to provide a locking cover assembly which is easy to move from the locking position to the unlocking position.

It is an object of the present invention to provide a locking cover assembly which includes a release or unlocking trigger positioned immediately adjacent to the start trigger of the conventional chain saw.

It is an object of the present invention to provide a cover for a chain and bar cutting assembly which allows ample clearance between the assembly and the inside surface of the cover.

It is an object of the present invention to provide a cover for surrounding a chain saw cutting assembly which can easily be moved away from the cutting assembly responsive to actual cutting by downward movement of the cutting bar.

It is an object of the present invention to provide a locking cover assembly which will automatically close the cover down at any time that the saw is not making a cut.

It is an object of the present invention to provide a locking cover assembly which will automatically be locked in place surrounding the saw when the saw is at rest.

It is an object of the present invention to provide a locking cover assembly which includes spring biasing means which are rigid enough to hold the cover closed when the saw is held upside down without the aid of the locking system.

It is an object of the present invention to provide a locking cover assembly wherein the cover includes a plurality of air vents to reduce the floating of the cover during closing thereof.

It is an object of the present invention to provide a locking cover assembly including a stopper bar which maintains the cover at a predetermined distance from the cutting assembly.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
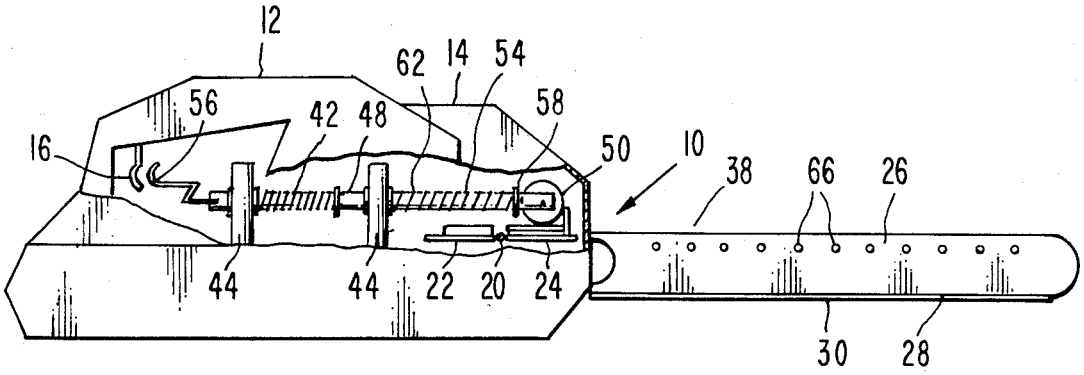
FIG. 1 is a side view of an embodiment of the locking cover assembly of the present invention shown in the closed position.

The present invention provides a locking cover assembly 10 which provides particular advantages of usage when used in combination with the chain saw 12 having a conventional configuration of a housing 14, a start trigger 16 and a chain and bar cutting assembly 18.

The locking cover assembly 10 includes a hinge means 20 comprising a rear hinge member 22 and a front hinge member 24. Rear hinge member 22 is fixedly secured with respect to the housing and front hinge member 24 is fixedly secured with respect to a cover means 26. In this manner cover means 26 is pivotally movable with respect to the housing 14 by way of hinge means 20.

A cutting slot 28 is defined longitudinally along the bottom edge of the cover means 26 to allow movement of the blade of the chain saw 12 downwardly therethrough or on the other hand movement of the cover means 26 upwardly with respect to the chain and bar cutting assembly 18. During cutting it is preferable to include wing means 30 extending longitudinally along each edge of cutting slot 28. These wing means 30 contact the workpiece such as a log 52 to maintain contact therewith during cutting. The bottom edge 32 of the cutting means is thereby better maintained in contact with the workpiece 52 by way of wing means 30.

Figure 6:
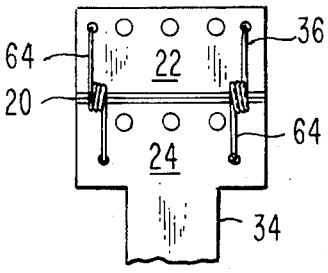
FIG. 6 is a top plan view of the hinge means and tongue means assembly of an embodiment of the present invention.
Figure 7:
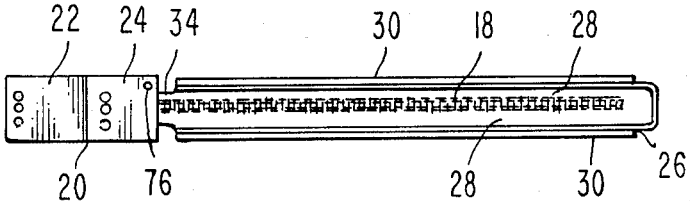
FIG. 7 is a bottom plan view of an embodiment of the hinge and cover assembly of the present invention.
Figure 8:
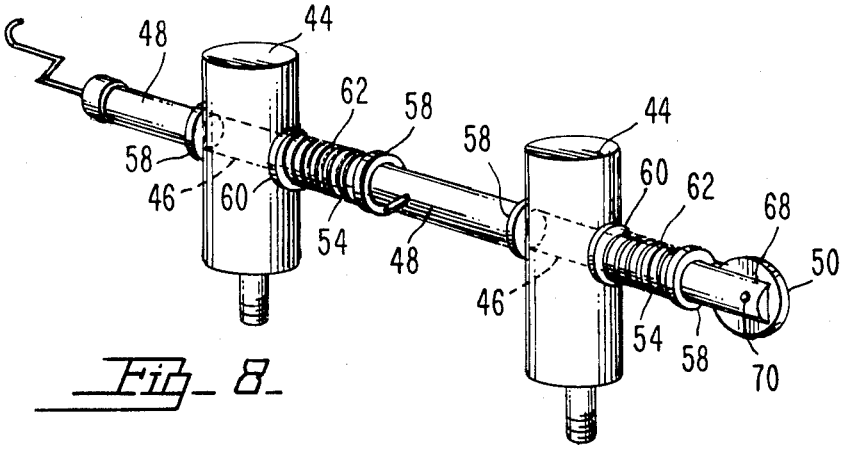
FIG. 8 is a side plan view of an embodiment of the locking apparatus of the present invention.
Figure 9:
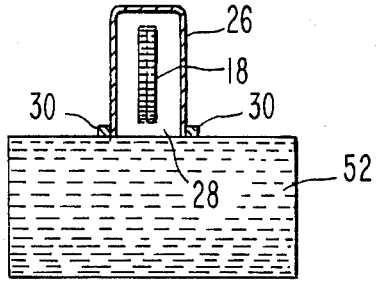
FIG. 9 is a front view of an embodiment of the locking cover assembly and chain saw of the present invention shown in the pre-cutting position.
Figure 10:
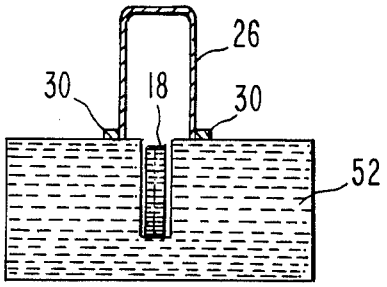
FIG. 10 is a view of the embodiment shown in FIG. 9 in the partially cut position.
Figure 11:
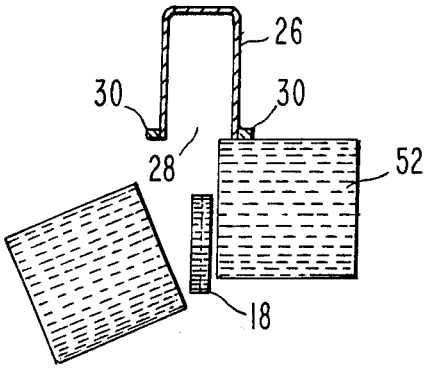
FIG. 11 is a view of the embodiment shown in FIG. 9 upon completion of cutting of a workpiece.
Figure 12:
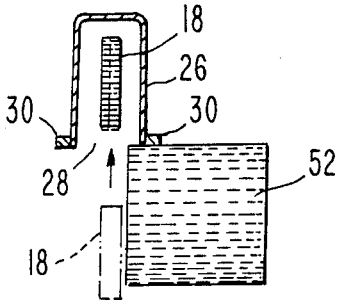
FIG. 12 is a view of the embodiment shown in FIG. 11 with part of the workpiece removed after cutting.

A tongue means 34 is preferably included which is fixedly secured with respect to the cover means 26. Tongue means 34 provides the means for securement of the cover means 26 with respect to the hinge means 20. In particular tongue means 34 is secured to the front hinge member 24 to thereby allow the cover means 26 to be pivotally movable with respect to housing 14. A cover biasing means 36 such as a horizontal spring means 64 as shown best in FIG. 6 may be connected to the rear hinge member 22 and the tongue 34 to urge hinge means 20 into down position or the closed position of cover means 26. In this manner when the chain saw 12 is at rest the cover means 26 will be biased by cover biasing means 36 into the closed position 38 in closing the chain and bar cutting assembly 18.

The cover biasing means 36 is movable between this closed position 38 and the opened position 40. Opened position 40 is shown best in FIG. 2 and closed position 38 is shown best in FIG. 1. These are the two possible positions of the locking cover assembly 10 of the present invention with respect to the chain saw 12.

The locking apparatus 42 is movable to lock the cover means 26 in the closed position 38 or is movable to the opened position to allow the cover means 26 to be in the opened position 40. The locking apparatus includes a plurality of guide rods 44 each defining a guide aperture 46 extending therethrough. A locking pin 48 is movably positioned within the guide apertures 46. The end of the locking pin 48 closest to the cover means includes a wheel means 50 secured thereto. In particular the end of the locking pin 48 may define a wheel slot 68 across which a wheel axle 70 extends. The wheel means 50 may be rotatably mounted upon the wheel axle 70 for free rotational movement. In a steady-state position a locking pin biasing means 54 will urge the locking pin to the closed position 38. A lock trigger 56 is fixedly secured with respect to the locking pin 48 such that when the trigger 56 is pulled the locking pin biasing means 54 is overcome and the locking pin 48 moves to the opened position 40 allowing cutting by the chain and bar cutting assembly 18. This locking pin biasing means 54 preferably takes the form of a locking pin spring means 62 which is wrapped around the locking pin 48 between a first washer means 58 and a second washer means 60. The first washer means 58 is preferably fixedly secured with respect to the locking pin and the second washer means 60 is preferably fixedly secured with respect to the guide rods to thereby allow the locking pin spring means 62 to bias the locking apparatus 42 into the closed position 38.

To facilitate movement of the cover means 26 to the closed position 38 a plurality of ventilating holes 66 are located therein. This prevents floating of the cover when closing due to the compression of air as the chain and bar cutting assembly 18 is moved through the cutting slot 28 into the interior of cover means 26.

To facilitate downwardly exerted bias by wheel means 50 against the hinge means 20, a wheel rear runner 72 is fixedly secured with respect to the upper surface of rear hinge 22. The wheel front runner 74 is fixedly secured with respect to the tongue means 34 which is secured to the upper surface of the front hinge member 24. These runners 72 and 74 provide a guiding means for movement for rolling of the wheel means 50 from a position immediately above the rear hinge member 22 to a position immediately above the tongue means 34 and front hinge member 24 and vice versa. When located above the rear hinge member 22, the wheel means will downwardly exerted bias against wheel rear runner 72 which is the opened position 40 of the locking apparatus 42. On the other hand, when the wheel means is positioned immediately above tongue means 34, a downwardly exerted bias will be created upon the front hinge member 24 thereby maintaining the locking apparatus 42 in the closed position 38.

To control the downward movement of the cover means 26, a stop bar means 76 and a stopper bar plate means 78 are included in the apparatus of the present invention. This stopper bar plate is fixedly secured with respect to the housing 14 of the chain saw 12 and the stopper bar means 76 is fixedly secured with respect to the front hinge member 24. As the cover means 26 moves downwardly toward a position surrounding the chain and bar cutting assembly 18, the stopper bar means will contact the stopper bar plate thereby maintaining a predetermined distance between the chain and bar cutting assembly 18 and the surrounding interior surface of the cover means 26. To facilitate contact between the stopper bar means 76 and the stopper bar plate 78, the stopper bar means may include a rubber tip 77 thereon.

Figure 13:
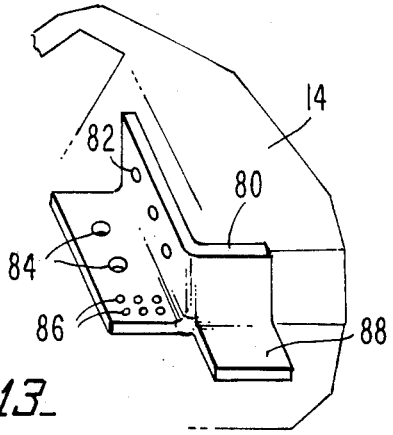
FIG. 13 is a perspective view of the mounting bracket fixed to the housing.

To facilitate mounting of the locking cover assembly with respect to the housing 14, a mounting bracket 80 may be included as shown in FIG. 13. Mounting bracket 80 is secured with respect to housing 14 by bracket mounting screws 82. The front portion is adapted to receive the stopper bar plate 78 mounted thereon. In the side area of mounting bracket 80, guide rod mounting holes 84 are defined and are adapted to have the guide rods mounted therein. Furthermore, hinge mounting holes 86 are defined in the side area of mounting bracket 80 to attach the rear hinge member 22 thereto.

Figure 2:
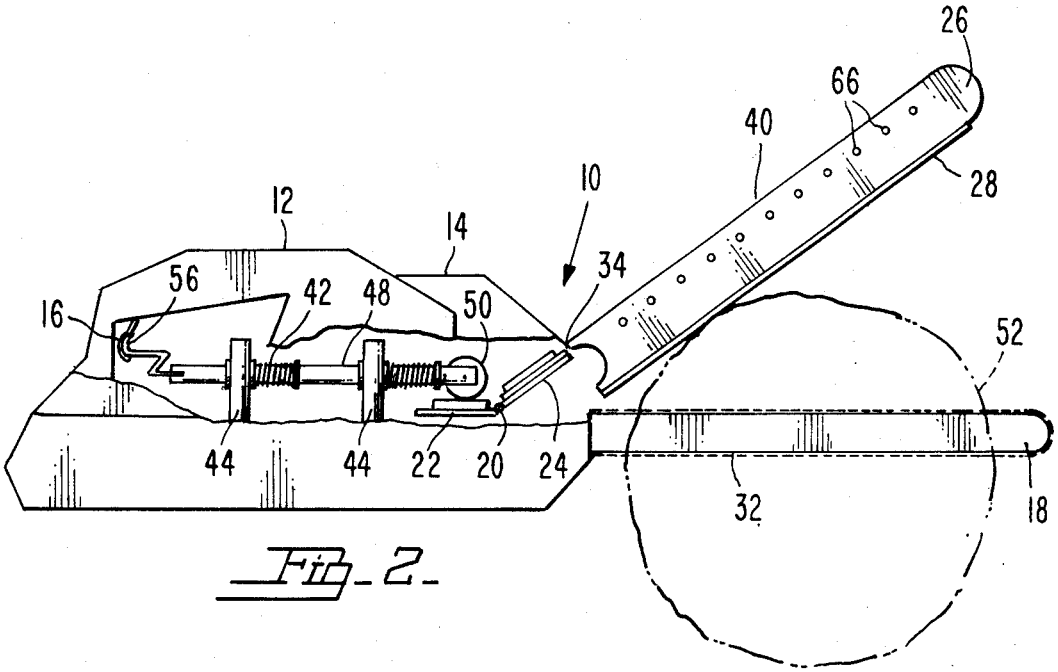
FIG. 2 is a view of the embodiment of the assembly shown in FIG. 1 in the opened position.
Figure 3:
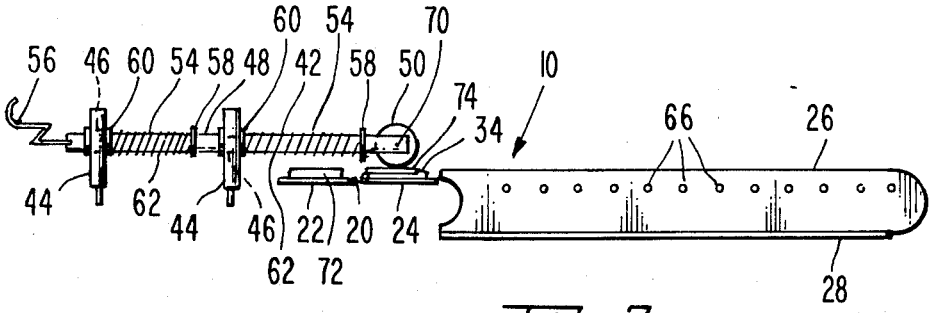
FIG. 3 is a side plan view of the locking cover assembly of the present invention shown without the chain saw itself.
Figure 4:
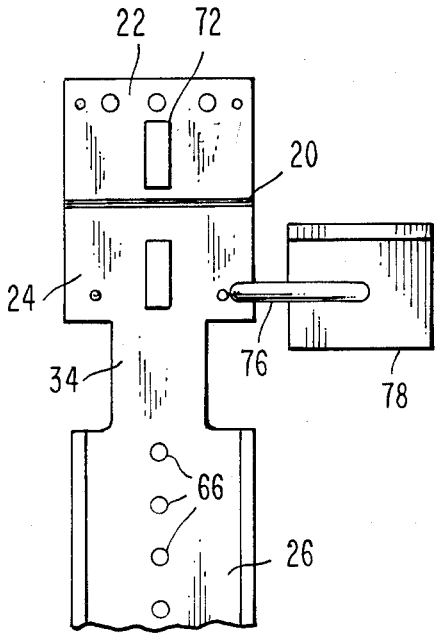
FIG. 4 is a top plan view of the locking cover assembly of the present invention.
Figure 5:
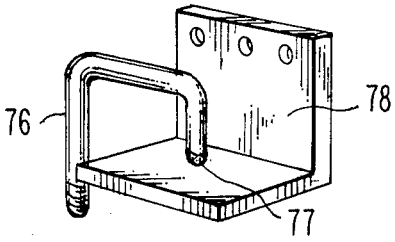
FIG. 5 is a front plan view of the stopper bar and stop plate assembly of the present invention.

In operation, the present invention will initially be in the steady-state position shown in FIG. 1 which is the closed position 38. When it is desired for the user to initiate operation, he will pull the start trigger 16 to start the chain saw 12 operating as well as the lock trigger 56 which will move the wheel means 50 from a position exerting downward bias on the wheel front runner 74 to a position where it exerts downward bias on the wheel rear runner 72. This will place the locking apparatus 42 in the opened position 40 allowing upward movement of the cover means 26 as the chain and bar cutting assembly 18 cuts downwardly through workpiece 52 as shown best in FIGS. 9 through 12. Wing means 30 will facilitate contact between the edges of cutting slot 28 and workpiece 52 in such a manner as to allow the chain and bar cutting assembly 18 to move directly downwardly therefrom to facilitate cutting.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A locking cover assembly, for use with a conventional chain saw having a housing, a start trigger and a chain and bar cutting assembly, the invention comprising:

(a) a hinge means including a rear hinge member and a front hinge member pivotally secured with respect to one another, said rear hinge member being fixedly secured with respect to the housing of the chain saw;

(b) a cover means extending about the chain and bar cutting assembly and defining a cutting slot extending longitudinally along the bottom edge thereof, said cover means including a tongue means fixedly secured thereto which is secured with respect to said front hinge member to allow said cover means to be pivotally secured with respect to the housing;

(c) a cover biasing means secured with respect to said front hinge member and with respect to said rear hinge member to urge said cover means into the closed position covering the chain and bar cutting assembly; and (d) a locking apparatus including:

(1) a plurality of guide rods fixedly secured with respect to the housing and each defining at least one guide aperture therethrough;

(2) a locking pin positioned extending through said guide apertures and being longitudinally movable therethrough between a closed position adjacent said tongue means of said cover means and an opened position adjacent to the housing;

(3) a wheel means rotationally secured to said locking pin at the end thereof adjacent to said cover means and being responsive to said locking pin being in the closed position to urge said cover means into the closed position about the chain and bar cutting assembly and being further responsive to said locking pin being in the opened position to be positioned immediately above said rear hinge member to release said cover means;

(4) a locking pin biasing means adjacent said locking pin to urge said locking pin toward the closed position; and (5) a lock trigger fixedly secured with respect to said locking pin adjacent to the start trigger of the chain saw to urge said locking pin and said wheel means toward the opened position to release said cover means for upward movement thereof responsive to pulling of said lock trigger and the start trigger.

2. The assembly as defined in claim 1 further including a first washer means fixedly retained to said locking pin, and a second washer means fixedly secured with respect to said guide rods with said locking pin biasing means comprising a locking pin spring means wound around said locking pin between said first washer means and said second washer means.

3. The assembly as defined in claim 1 wherein said cover biasing means comprises a horizontal spring means.

4. The assembly as defined in claim 1 wherein said cover means defines a plurality of ventilating holes therein.

5. The assembly as defined in claim 1 further including a wheel slot defined in the end of said locking pin adjacent to said tongue means and further including a wheel axle extending therethrough upon which said wheel means is rotatably mounted.

6. The assembly as defined in claim 1 further including a wheel rear runner fixedly secured with respect to said rear hinge member to facilitate donward bias exerted by said wheel means thereon when said locking apparatus is in the opened position and to guide movement of said wheel means from the opened position to the closed position and vice versa.

7. The assembly as defined in claim 1 further including a wheel front runner fixedly secured with respect to said tongue means to facilitate downward bias exerted by said wheel means thereon when said locking apparatus is in the closed position and to guide movement of said wheel means from the opened position to the closed position and vice versa.

8. The assembly as defined in claim 1 further including a stop bar means fixedly secured to said front hinge member and further including a stopper bar plate fixedly secured with respect to the housing and positioned adjacent to said stop bar means and adapted to be selectively abutted by said stop bar means to limit the downward distance of movement of said cover means with respect to the chain and bar cutting assembly to maintain a predetermined desired distance therebetween.

9. The assembly as defined in claim 1 further including wing means extending longitudinally along each side of said cutting slot to abut a workpiece during cutting to facilitate relative upward movement of said cover means with respect to the chain and bar cutting assembly.

10. A locking cover assembly, for use with a conventional chain saw having a housing, a start trigger and a chain and bar cutting assembly, the invention comprising:

(a) a hinge means including a rear hinge member and a front hinge member pivotally secured with respect to one another, said rear hinge member being fixedly secured with respect to the housing of the chain saw;

(b) a cover means extending about the chain and bar cutting assembly and defining a cutting slot extending longitudinally along the bottom edge thereof, said cover means including a tongue means fixedly secured thereto which is secured with respect to said front hinge member to allow said cover means to be pivotally secured with respect to the housing, said cover means defining a plurality of ventilating holes therethrough;

(c) a cover biasing means comprising a horizontal spring means secured with respect to said front hinge member and with respect to said rear hinge member to urge said cover means into the closed position covering the chain and bar cutting assembly;

(d) a locking apparatus including:

(1) a plurality of guide rods fixedly secured with respect to the housing and each defining at least one guide aperture therethrough;

(2) a locking pin positioned extending through said guide apertures and being longitudinally movable therethrough between a closed position adjacent said tongue means of said cover means and an opened position adjacent to the housing;

(3) a wheel means rotationally secured onto said wheel axle at the end thereof adjacent to said cover means and being responsive to said locking pin being in the closed position to urge said cover means into the closed position about the chain and bar cutting assembly and being further responsive to said locking pin being in the opened position to be positioned immediately above said rear hinge member to release said cover means, said assembly further including a wheel rear runner fixedly secured with respect to said rear hinge member to facilitate downward bias exerted by said wheel means thereon when said locking apparatus is in opened position, and further including a wheel front runner fixedly secured with respect to said tongue means to facilitate downward bias exerted said wheel means thereon when said locking apparatus is in the closed position and to guide movement of said wheel means from the open position to the closed position and vice versa;

(4) a locking pin biasing means adjacent said locking pin to urge said locking pin toward the closed position, said assembly further including a first washer means fixedly retained to said locking pin, and a second washer means fixedly secured with respect to said guide rods which said locking pin biasing means comprising a locking pin spring means wound around said locking pin between said first washer means and said second washer means; and (5) a lock trigger fixedly secured with respect to said locking pin adjacent to the start trigger of the chain saw to urge said locking pin and said wheel means toward the opened position to release said cover means for upward movement thereof responsive to pulling of said lock trigger and the start trigger;

(e) a stop bar means fixedly secured to said front hinge member;

(f) a stopper bar plate fixedly secured with respect to the housing and positioned adjacent to said stop bar means and adapted to be selectively abutted by stop bar means to limit the downward distance of movement of cover means with respect to the chain and bar cutting assembly to maintain a predetermined desired distance therebetween; and (g) a wing means extending longitudinally along each side of said cutting slot to abut a workpiece during cutting to facilitate relative upward movement of said cover means with respect to the chain and bar cutting assembly.

* * * * *